US005893562A

United States Patent [19]

Spector

[11] Patent Number: 5,893,562

[45] Date of Patent: Apr. 13, 1999

[54] SHOOTER AND TARGET WATER GUN GAME

[76] Inventor: Donald Spector, Union City, N.J.

[21] Appl. No.: 08/993,611

[22] Filed: Dec. 18, 1997

Related U.S. Application Data

[63] Continuation-in-part of application No. 08/874,519, Jun. 16, 1997, abandoned.

[51] Int. Cl.[6] ..... A63B 67/00

[52] U.S. Cl. ..... 273/349; 273/371

[58] Field of Search ..... 273/349, 371

[56] References Cited

U.S. PATENT DOCUMENTS

| | | | |
|---|---|---|---|
| 4,586,715 | 5/1986 | Scolari | 463/50 |
| 5,411,269 | 5/1995 | Thomas | 273/349 |
| 5,626,343 | 5/1997 | Sanders | 273/349 |

*Primary Examiner*—William H. Grieb

[57] ABSTRACT

A mock battle game for children in which each player in the role of a shooter is provided with a toy water gun which when triggered, projects a beam of water in the direction in which the gun is aimed. Each player who acts as a target wears a vest having at least one target zone that includes a water-sensor module housing a water-absorbent, non-conductive pad having embedded therein a pair of spaced electrodes. The pad is impregnated with salt crystals to form a resistance bridge between the electrodes which function as a normally open switch to connect a battery in the vest to an integrated circuit unit. When the switch is closed, the unit then generates a visible or audible signal. In the course of play when a shooter-player succeeds in striking the target zone on the vest of a target-player to wet the module therein, the salt crystals are then dissolved to produce a conducive salt solution that closes the switch, the resultant signal being indicative of a hit.

9 Claims, 2 Drawing Sheets

FIG. 1
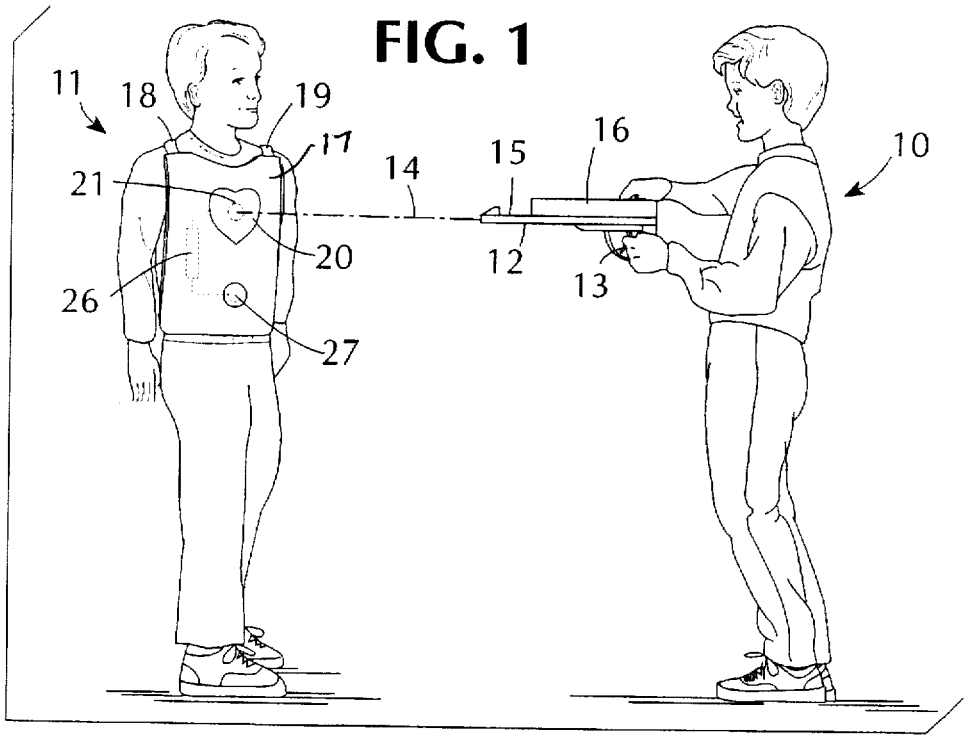
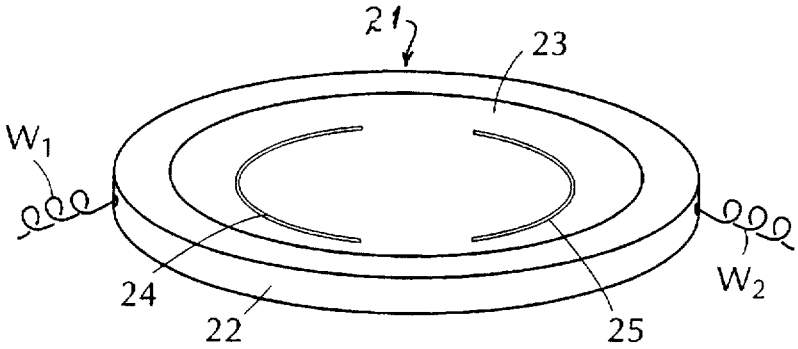
FIG. 2
FIG. 3
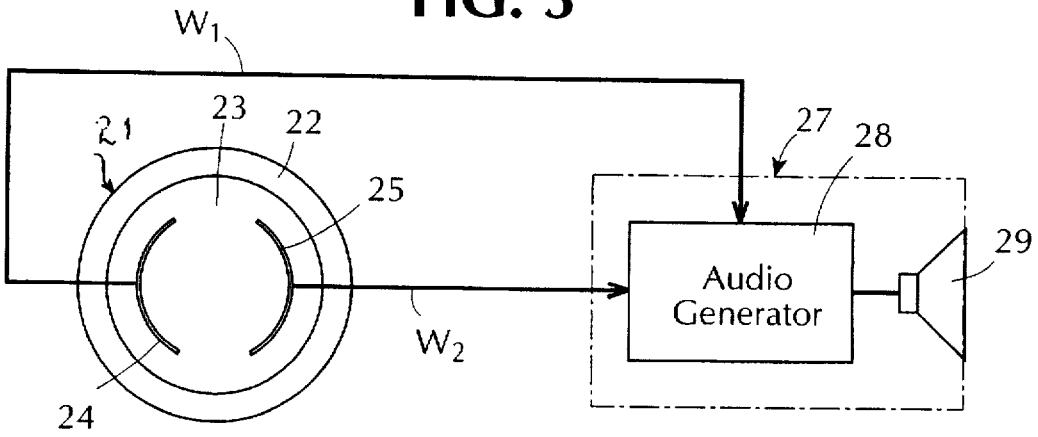

SHOOTER AND TARGET WATER GUN GAME

RELATED APPLICATION

This application is a continuation-in-part of my application Ser. No. 08/874,519, filed Jun. 16, 1997 entitled "Toy Vehicle Having Laser Beam Turret Gun For Playing War Games," now abandoned whose entire disclosure is incorporated herein by reference.

BACKGROUND OF THE INVENTION

1. Field of Invention

This invention relates generally to shooter and target games for children, and more particularly to a game in which a shooter-player is provided with a water gun that when triggered projects a water beam in the direction in which the gun is aimed, and in which a target player wears a vest having a target zone therein which when struck and made wet by the water beam, then produces a switching action to activate a battery-powered unit which emits an audible or visible signal indicative of a hit.

2. Status of Prior Art

A game whose popularity with children is of long standing is one involving a mock battle between "good" and "bad" guys. These good and bad guys may assume many different guises, such as cowboys and indians, cop and robbers, humans and outer-space aliens or whatever other hostile opponents are in vogue with children. But regardless of the character of the opponents, the theme common to these games is that a player provided with a toy weapon assumes the role of a shooter seeking to strike an opposing player who acts as a target. In most such games, each player is both a shooter and target.

In recent years, the usual toy weapon for playing shooter-target games has been a laser-beam gun, the shooter-player who holds this gun shooting out a simulated laser beam which he aims in the direction of a target worn by an opposing player. Thus the Scarlari et al. U.S. Pat. No. 4,586,715 discloses a toy laser pistol which includes a flash unit to generate, when the gun is triggered, a burst of high-intensity light. The light is collimated to produce a beam simulating a laser beam. A vest worn by a player who acts as the target is provided with a target area of fluorescent material. This material glows to indicate a hit when a light beam from the toy laser gun strikes the fluorescent target area.

In my above-identified co-pending application there is disclosed a war game assembly for children involving at least two opposing toy vehicles, each having a battery-powered motor for driving the vehicle whereby a player in a driver's seat in the cockpit can steer his vehicle in the direction of the opposing vehicle to engage the vehicle in combat. Each vehicle is provided in front of the cockpit with a laser beam turret gun powered by the vehicle battery, making it possible for the driver to aim the beam toward the opposing vehicle, the gun when triggered producing gun shot sounds.

Mounted on the fender of each vehicle is a hit register having a photodetector which when struck by a beam emanating from the other vehicle, produces both an indication of a hit and counts the number of hits scored. Hence in simulated combat, players driving in opposing vehicles each seek to score the greatest number of hits.

The major drawback of a laser-beam toy gun is that the light beam projected therefrom when the gun is triggered is not visible under daylight conditions, thereby making it necessary to generate shooting sounds so that one is then aware that a beam is being projected. And when as in the Scarlari patent, this target is a fluorescent area, this area is ineffective in daylight hours when it is exposed to natural light, for the target is then always "on".

Toy weapons which shoot out a water beam that can be aimed at an opposing player have obvious advantages over laser beam guns. With a watergun, a player can in the daytime see the beam of water and also see when this beam strikes an opposing player and where he has hit the player.

But the disadvantage of a water gun, even those currently available which are capable of projecting a water beam over a relatively long distance, is that when the beam strikes and wets a player there is nothing to then indicate that the target has been hit or where it has been hit other than the fact that the target is wet in the region struck by the water beam. But a wet target does not look very different from the same target when dry.

SUMMARY OF INVENTION

In view of the foregoing, the main object of this invention is to provide a mock battle game for children in which each player acting as a shooter is provided with a water gun which when triggered projects a beam of water in the direction in which the gun is aimed, and in which each player acting as a target wears a vest having a target zone that which when made wet by a beam impinging thereon activates a battery-powered integrated circuit unit producing a visual or audible signal indicative of a hit.

A significant feature of a game in accordance with the invention is that the target zone on the vest worn by the target-player includes a water-sensor module that reacts to water impinging thereon to produce an electrical switching action which activates the unit generating a visible or audible signal.

More particularly an object of this invention is to provide a game of the above type in which the vest worn by the player has multiple target zones at different locations, each target zone when hit by a water beam, producing a signal indicative of its location.

Briefly stated, these objects are attained by a mock battle game for children in which each player in the role of a shooter is provided with a toy water gun which when triggered, projects a beam of water in the direction in which the gun is aimed. Each player who acts as a target wears a vest having at least one target zone that includes a water-sensor module housing a water-absorbent, non-conductive pad having embedded therein a pair of spaced electrodes. The pad is impregnated with salt crystals to form a resistance bridge between the electrodes. The electrodes which function as a normally open switch connecting a battery in the vest to an integrated circuit unit.

When the switch is closed, it then generates a visible or audible signal. In the course of play when a player-shooter succeeds in striking the target zone on the vest of a target-player to wet the module, the salt crystals are then dissolved to produce a conductive salt solution that closes the switch, the resultant signal being indicative of a hit.

BRIEF DESCRIPTION OF DRAWINGS

For a better understanding of the invention as well as other objects and further features thereof, reference is made to the following detailed description to be read in conjunction with the accompanying drawings, wherein:

FIG. 1 illustrates a shooter-player and a target-player participating in a mock battle game in accordance with the invention.

FIG. 2 is a perspective view of the module included in a target zone in the vest worn by the target player;

FIG. 3 is a schematic diagram of the circuit associated with the module;

DESCRIPTION OF INVENTION

First Embodiment

Figure 4:
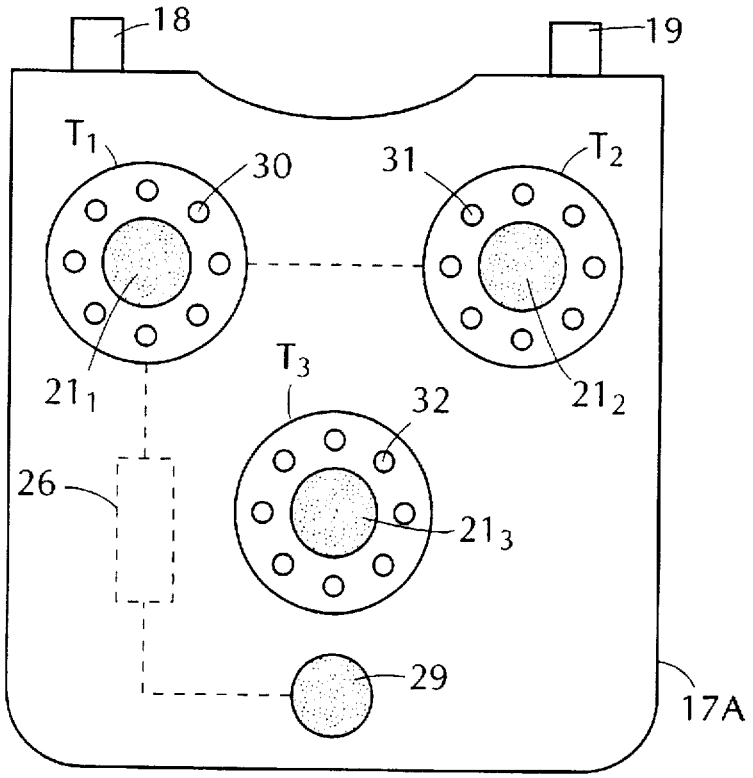
FIG. 4 illustrates another embodiment of the vest worn by the target player, the vest having multiple target zones.

Referring now to FIG. 1, shown therein are two players 10 and 11 who are participants in a mock battle game in accordance with the invention, player 10 acting in this game as a shooter and player 11 as a target.

Shooter-player 10 is armed with a toy water gun 12 having a trigger 13 which when pulled causes a beam 14 of water to be projected from the barrel 15 of the gun in the direction in which the gun is aimed. Mounted above the barrel of the gun is a replenishable bottled water reservoir 16 supplying water to the pump mechanism of the gun. In practice, all shooter-players participating in a mock battle game should be armed with identical water guns and thereby be put on an equal footing in the game.

Target-player 11 is shielded by a vest 17 formed of fabric or plastic sheeting that overlies the front side of the player's body to shield it from water emanating from a shooter-player's gun. Vest 17 is held in place by a pair of straps 18 and 19 forming loops that go over the shoulders of the player whose arms extend through the loops. In practice a player can be both a shooter and a target, hence a player wearing the vest is armed with a water gun.

Printed on vest 17 at a position roughly adjacent the heart of the player wearing the vest is a heart-shaped target zone 20. In practice, the target zone may be printed in red or in another contrasting color on a white-colored vest to render it more visible. Mounted on vest 17 within target zone 17 is a water-sensor module 21 which when rendered wet by a water beam impinging on the target zone produces an electrical switching action.

Module 21 is formed by a shallow cylindrical cup 22 as shown in FIGS. 2 and 3, molded of synthetic plastic material, such as polyethylene, and a circular pad 23 socketed in the cap. Pad 23 is made of non-conductive highly absorbent material, such as open-cell polyurethane. Embedded in pad 23 at diameterically-opposed positions is a pair of arcuate metal electrodes 24 and 25 which conform to the curvature of the cylindrical cap.

The cells of the porous pad 23 are impregnated with solid sodium chloride crystals. These form a high-resistance bridge between electrodes 24 and 25 which functions as the contacts of a normally-open switch to which wires $W_1$ and $W_2$ are connected. When the module is made wet, the salt crystals are dissolved to produce a conductive salt solution which bridges the electrodes and closes the switch.

As shown in FIGS. 1 and 2, switching module 21 is connected through a battery power pack 26, installed in the vest so that it is accessible through the rear thereof, to an integrated circuit unit 27. This unit includes an audio signal generator 28 whose output is coupled to a miniature loud speaker 29. When the switch is closed by water to actuate unit 27, the unit then generates a clearly audible pulsed high-frequency signal that can be heard by all players participating in the game.

As shown in FIG. 1, unit 27 is mounted on the vest below the target zone 20, and power pack 26 is supported at the rear of the vest at a position adjacent unit 27. The power pack installation on the vest must be such that an exhausted power pack can readily be replaced by a fresh pack.

In the course of play when a shooter-player 10 succeeds in aiming his gun so that the water beam 14 projected therein strikes target zone 20 on vest 17 worn by target-player 11, the module 21 within this zone is not made wet unless the beam impinges on the module. However, when the water beam strikes the target zone, the player holding the water gun can then scan the zone with the beam to impinge the beam on the module.

When the module is made wet, the resultant switching action activates the sound generating unit 27 and all players in the game are then aware from the resultant high-pitched pulse sounds which player has been hit and struck out of the game. When a player is hit in his heart zone, he is then rendered incapable of continuing to play.

When there are say seven players participating in the game and each player is armed with a water gun, all other players are opponents and each player seeks to strike out the other players.

In the course of play, as players are hit in their heart zone and eliminated from the game, when only one player remains who has not been hit, this player is the winner of the game.

Second Embodiment

Figure 5:
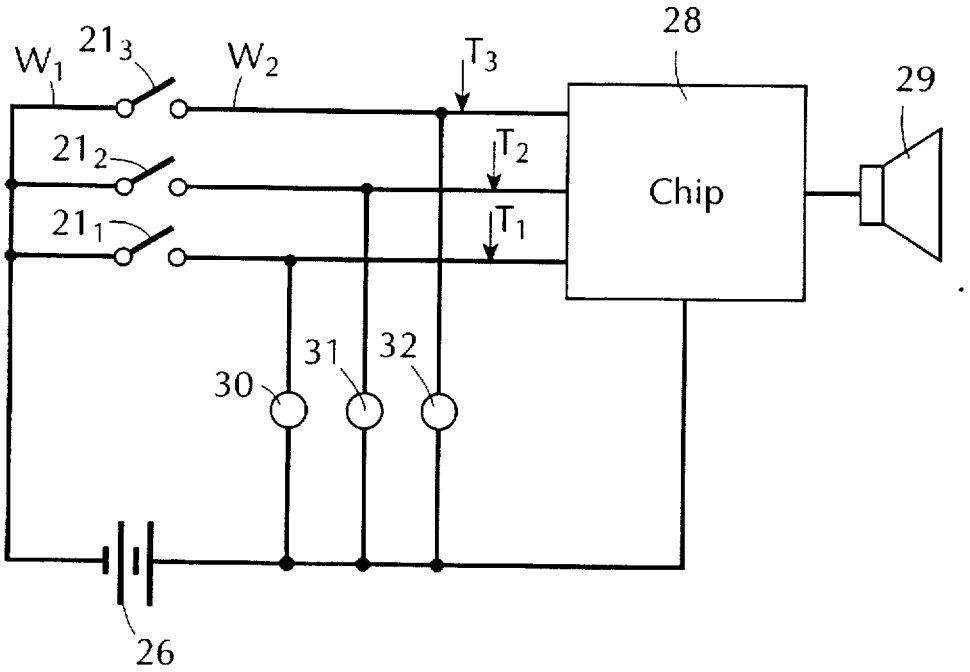
FIG. 5 is a schematic circuit diagram of the multiple module vest.

The shooter-player 10 and the target player 11 participating in a game in accordance with the invention are omitted from FIGS. 4 and 5 which illustrate the second embodiment of a vest 17A worn by the target player 11. Vest 17A differs from vest 17 in FIG. 1 in that instead of a single target zone, there are three circular target zones $T_1$, $T_2$ and $T_3$.

Placed within these zones are switch modules $21_1$, $21_2$, and $21_3$, respectively. When these modules which are the same as module 21 in FIG. 2 are made wet by a water beam, they are then rendered electrically conductive to provide a switch action to connect battery 26 to chip 28. When activated, chip 28 generates an audio signal that is reproduced by loud speaker 29 mounted on the vest to indicate a hit.

In the second embodiment, each module is surrounded by a circular array of light-emitting diodes (LED's) which emit a light whose color depends on the chemistry of the LED material (red, green or yellow). The vest arrangement is such that targets $T_1$, $T_2$ and $T_3$ are placed at the corners of an equilateral triangle. When module $21_1$ in target $T_1$ is made wet and switched on, this causes the circular array of LED's 30 surrounding this module to produce a luminous red ring.

When the circular array of LED's 31 surrounding switch module $21_2$ of target $T_2$ are simultaneously activated, this results in a luminous red ring. And when the circular array of LED's 32 surrounding switch module $21_3$ of target $T_3$ are simultaneously activated, a luminous yellow ring is produced.

This multi-color target arrangement permits a hit to be scored in accordance with the color of the target to strike out a player, one must hit and wet the module $21_3$ of target $T_3$ to produce a green light in which case the struck-out player is ejected from the game. But hitting either target $T_2$ or target $T_1$ will not strike out a player, for to strike out a player, one must hit both targets so that both a yellow and green light are produced.

FIG. 5 illustrates the manner in which the circular arrays of LED's are connected, each array being represented by a single LED. In the line of target $T_1$ it will be seen that LED 30 is connected to battery 26 through the switch module $21_1$ in this target. Hence the LED array 31 is activated only when this target is wet and hit. The LED array 31 in the line of target $T_2$ is connected to the switch $21_2$ in this target and this array is only lit up when this switch is closed. And the LED array 32 in the line of target $T_3$ is activated only when module $21_3$ in this target is hit and made wet.

Audio generator chip 28 is arranged to produce a sonic signal whose nature depends on which one of the three module switches $21_1$, $21_2$ and $21_3$ is closed. Thus when target $T_1$ is made to close switch $21_1$, the resultant sound generated by the chip and reproduced by the loud speaker 29 could be siren-like in nature. And when target $T_2$ is made wet and switch $21_2$ is closed, the resultant sound could be horn-like which when target $T_3$ is made wet and switch $21_3$ is closed, high-pitched pulses are then produced.

While there has been shown and described preferred embodiments of a shooter and target water gun game in accordance with the invention, it will be appreciated that many changes and modifications may be made therein without, however, departing from the essential spirit thereof.

I claim:

1. A game for children comprising:

A. a shooter-player provided with a water gun which when triggered projects a beam of water in the direction in which the gun is aimed;

B. a target-player wearing a vest having at least one target zone thereon in which is mounted a water-sensing module having a salt therein which when made wet by the beam and dissolved thereby is rendered electrically conductive to provide a switching action; and C. means responsive to said switching action to produce a signal indicative of a hit.

2. A game as set forth in claim 1, in which the module is formed by a cup filled with an absorbent material in which is embedded a pair of spaced electrodes, said absorbent material being impregnated with salt crystals which when the module is made wet are dissolved to produce an electrically conductive solution bridging the electrodes.

3. A game as set forth in claim 2, in which said cup is molded synthetic plastic and said material is a pack of open-cell foam plastic socketed in said cup.

4. A game as set forth in claim 3, in which the salt is sodium-chloride.

5. A game as set forth in claim 1, in which said means includes an integrated circuit chip constituted by an audio-frequency generator which is powered by a battery when the switch module is rendered conductive to produce an audio-signal indicative of a hit.

6. A game as set forth in claim 1, in which said signal is a visual signal.

7. A game as set forth in claim 6, in which said means to produce a signal includes an LED.

8. A game as set forth in claim 1, in which said vest has a plurality of target zones thereon, each having a module mounted thereon which when made wet by the beam is rendered conductive to provide a switching action to produce a signal indicative of a hit.

9. A game as set forth in claim 8, in which said means produces both a visual signal and an audio signal.

* * * * *